US011540572B2

(12) United States Patent
Horbatuck

(10) Patent No.: US 11,540,572 B2
(45) Date of Patent: Jan. 3, 2023

(54) GARMENT WITH INSULATED LINER

(71) Applicant: Wesley Horbatuck, San Diego, CA (US)

(72) Inventor: Wesley Horbatuck, San Diego, CA (US)

( * ) Notice: Subject to any disclaimer, the term of this patent is extended or adjusted under 35 U.S.C. 154(b) by 43 days.

(21) Appl. No.: 16/735,559

(22) Filed: Jan. 6, 2020

(65) Prior Publication Data

US 2020/0214377 A1 Jul. 9, 2020

Related U.S. Application Data

(60) Provisional application No. 62/789,457, filed on Jan. 7, 2019.

(51) Int. Cl.
*A41D 31/06* (2019.01)
*A41D 7/00* (2006.01)

(52) U.S. Cl.
CPC ..... *A41D 31/06* (2019.02); *A41D 7/005* (2013.01)

(58) Field of Classification Search
CPC ..... A41D 31/06; A41D 7/005; A41D 7/001
USPC ..... 2/2.16
See application file for complete search history.

(56) References Cited

U.S. PATENT DOCUMENTS 1,271,248 A * 7/1918 Walcott ..... A41D 1/06 2/227
1,490,470 A * 4/1924 Laubach ..... A62B 17/001 2/227
2,072,184 A * 3/1937 Rheinauer ..... A41D 7/005 602/67
2,078,184 A * 4/1937 Russell ..... A41D 7/005 2/403
2,446,326 A * 8/1948 Guithues ..... A41D 7/005 2/238
2,453,051 A * 11/1948 Vacca ..... A41D 7/005 D2/738
2,483,076 A * 9/1949 Vacca ..... A41D 7/005 2/67
2,634,421 A * 4/1953 Ceraulo ..... A41D 7/005 2/67
2,775,776 A * 1/1957 Shaw ..... A41D 7/001 441/102
2,790,176 A * 4/1957 Cunningham ..... A41D 7/005 D2/738
2,854,669 A * 10/1958 Cohen ..... A41D 7/005 2/67
2,983,924 A * 5/1961 Cohen ..... A41D 7/005 2/67
3,127,896 A * 4/1964 Puliafico ..... A41D 1/06 450/95

(Continued)

FOREIGN PATENT DOCUMENTS

WO WO-2015117646 A1 * 8/2015 ..... A41D 7/00

*Primary Examiner* — Alissa L Hoey
(74) *Attorney, Agent, or Firm* — Robert Z. Evora, Esq.

(57) ABSTRACT

A garment with insulated liner including a short pant attached to an insulated undergarment. The insulated undergarment is adapted to cover and fit closely to the body of a wearer to preserve an elevated temperature of the body of the wearer under the insulated undergarment. A pair of front seams are provided to secure the short pant to the insulated garment. The front seams extend from a waist area through a pelvic area to a crotch area to prevent the insulated undergarment from drastically shifting in turbulent water.

11 Claims, 10 Drawing Sheets

(56) References Cited

U.S. PATENT DOCUMENTS 3,246,342 A * 4/1966 Pagano ..... A41D 1/06 2/227
3,333,589 A * 8/1967 Cohen ..... A41D 7/005 450/95
4,069,513 A * 1/1978 Shiller ..... A41D 1/06 2/212
4,946,453 A * 8/1990 Monson ..... A41D 31/18 604/312
5,010,595 A * 4/1991 Stradley ..... A41D 1/06 2/227
5,572,737 A * 11/1996 Valice ..... A41D 1/067 2/904
5,598,586 A * 2/1997 Munjone ..... A41D 1/089 2/237
5,636,380 A * 6/1997 Schindler ..... A41D 13/005 2/69
5,689,836 A * 11/1997 Fee ..... A41D 13/015 2/22
5,978,963 A * 11/1999 Moskowitz ..... A41D 31/185 2/67
6,035,448 A * 3/2000 Thomson ..... A41D 1/06 2/227
6,145,132 A * 11/2000 Towner ..... A41B 9/02 2/400
6,665,882 B1 * 12/2003 Pedrick ..... A41D 7/005 2/228
7,941,871 B1 * 5/2011 Jorgensen ..... A41D 7/005 2/238
D673,347 S * 1/2013 Sumpton ..... D2/738
8,407,815 B2 * 4/2013 Meschter ..... A41D 1/08 2/236
8,938,815 B2 * 1/2015 Vaughn ..... A41D 1/22 2/238
8,959,665 B1 * 2/2015 Garner ..... A41F 9/00 2/237
9,833,023 B2 * 12/2017 Sabin ..... A41B 9/001
10,463,085 B2 * 11/2019 McGargill ..... A41D 27/205
10,674,777 B2 * 6/2020 Fisher ..... A41D 27/204
11,134,733 B2 * 10/2021 Miller ..... A41D 1/06
2002/0053102 A1 * 5/2002 Vartanyan ..... A41B 9/02 2/403
2004/0177427 A1 * 9/2004 Pedrick ..... A41F 7/00 2/82
2005/0081275 A1 * 4/2005 Galvao ..... A41D 7/005 2/67
2005/0142986 A1 * 6/2005 Belpaume ..... A41D 7/005 450/99
2005/0283883 A1 * 12/2005 Fontes ..... A41D 1/06 2/238
2009/0064388 A1 * 3/2009 Baiany ..... A41D 27/02 2/67
2010/0125926 A1 * 5/2010 Simonetti ..... A41D 7/005 2/67
2010/0175171 A1 * 7/2010 Dye ..... A41B 9/04 2/406
2011/0078839 A1 * 4/2011 Leonard ..... A41D 7/005 2/67
2011/0203034 A1 * 8/2011 Shlafer ..... A41D 27/201 2/247
2011/0209267 A1 * 9/2011 Rush ..... A41D 1/089 2/228
2011/0225696 A1 * 9/2011 Di Lorenzo ..... A41D 7/00 2/67
2012/0117714 A1 * 5/2012 Peck ..... A41D 31/185 2/228
2012/0124712 A1 * 5/2012 Vanlandingham ..... A41D 7/005 2/67
2014/0283285 A1 * 9/2014 Rivera ..... A61F 13/49006 2/406
2016/0050987 A1 * 2/2016 Gust ..... A41D 1/08 2/227
2021/0274869 A1 * 9/2021 McNally ..... A41D 13/012

* cited by examiner

GARMENT WITH INSULATED LINER

CROSS REFERENCE TO RELATED APPLICATION

This application incorporates and claims the benefit of the filing date of U.S. Provisional Application Ser. No. 62/789,457, filed Jan. 7, 2019, the entirety of which is incorporated herein by reference.

TECHNICAL FIELD

The subject disclosure relates to a garment with an insulated liner for water sports, and in particular to a wet suit garment liner designed to be concealed under and uniquely attached to a pair of shorts.

BACKGROUND OF THE INVENTION

The sport of surfing is conventionally conducted during warm weather months. However, serious surfers may surf year-round even when the outside weather can be somewhat cold and uncomfortable. When the water and/or air is relatively warm, surfers generally prefer to wear only a bathing suit and/or a pair of board shorts. Despite the temperature of the air outside of the water, ocean water can be dramatically colder and somewhat frigid, and a need arises to attempt to keep warm.

Wet suits are required when the weather and/or water temperature is cooler. Wet suits are typically made of thermally insulating rubberized material such as neoprene, generally designed to fit close to the body. The neoprene creates a thin layer of water between the suit and the wearer's body. After the suit has been submerged, there is not much exchange of water such that a thin layer of water adjacent the wearer's body provides insulation to the wearer.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

FIGS. 1-7 illustrate a garment with insulated liner 10. The garment of the garment with insulated liner 10 may be a short pant 20. The insulated liner of the of the garment with insulated liner 10 may be an insulated undergarment or insulated liner 30. The insulated liner 30 is attached to the short pant 20 in a manner adapted to prevent excessive shifting or tearing away in a turbulent body of water.

The garment with insulated liner 10 is adapted to cover and conform to the body of a wearer from approximately a waist portion to the knees of the wearer and provide all around protection to elevate the temperature of the body of the wearer from the waist to the knees as well as to provide ultraviolet protection.

Figure 1:
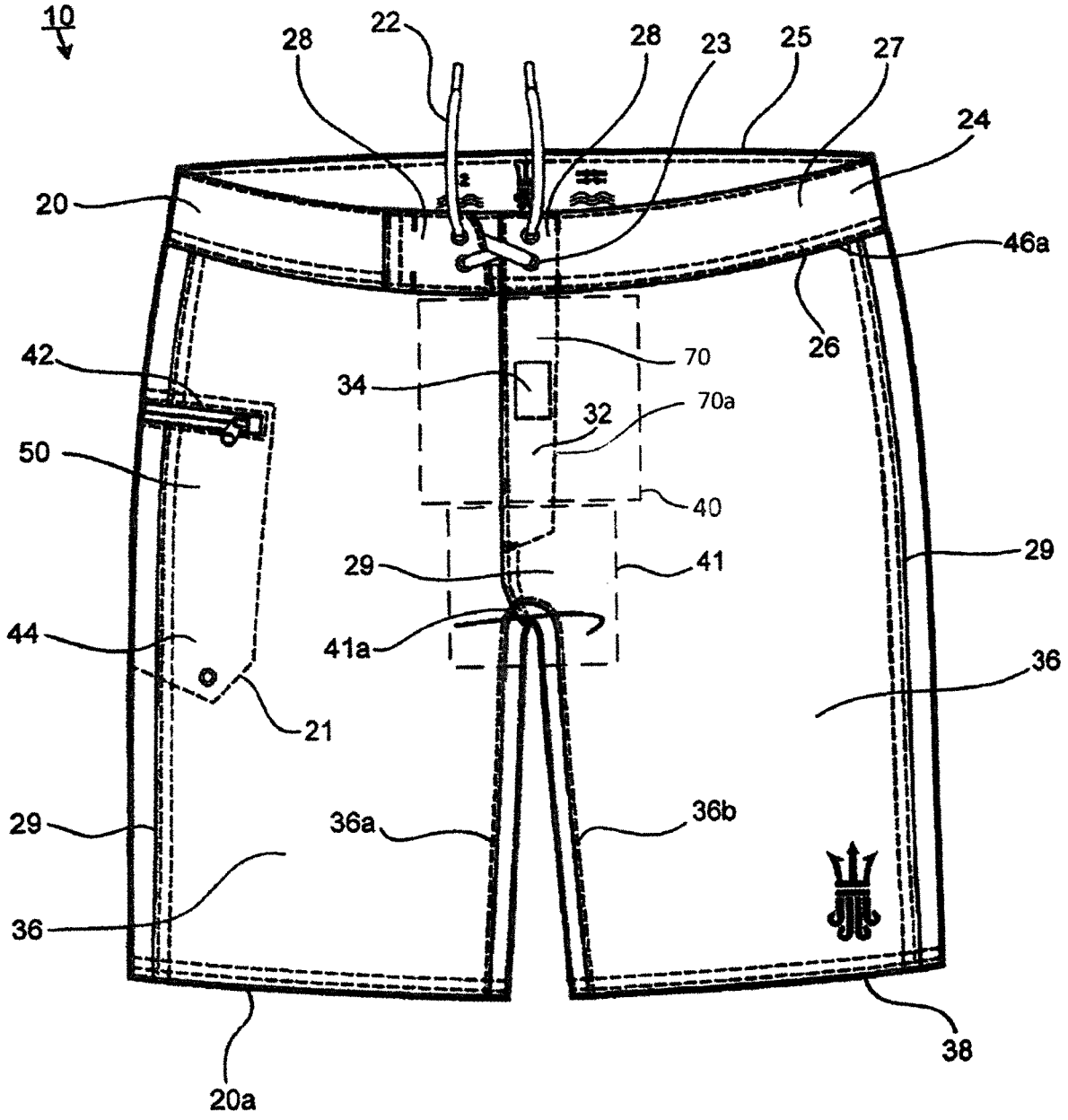
FIG. 1 is a front view of a garment with insulated liner.
Figure 2:
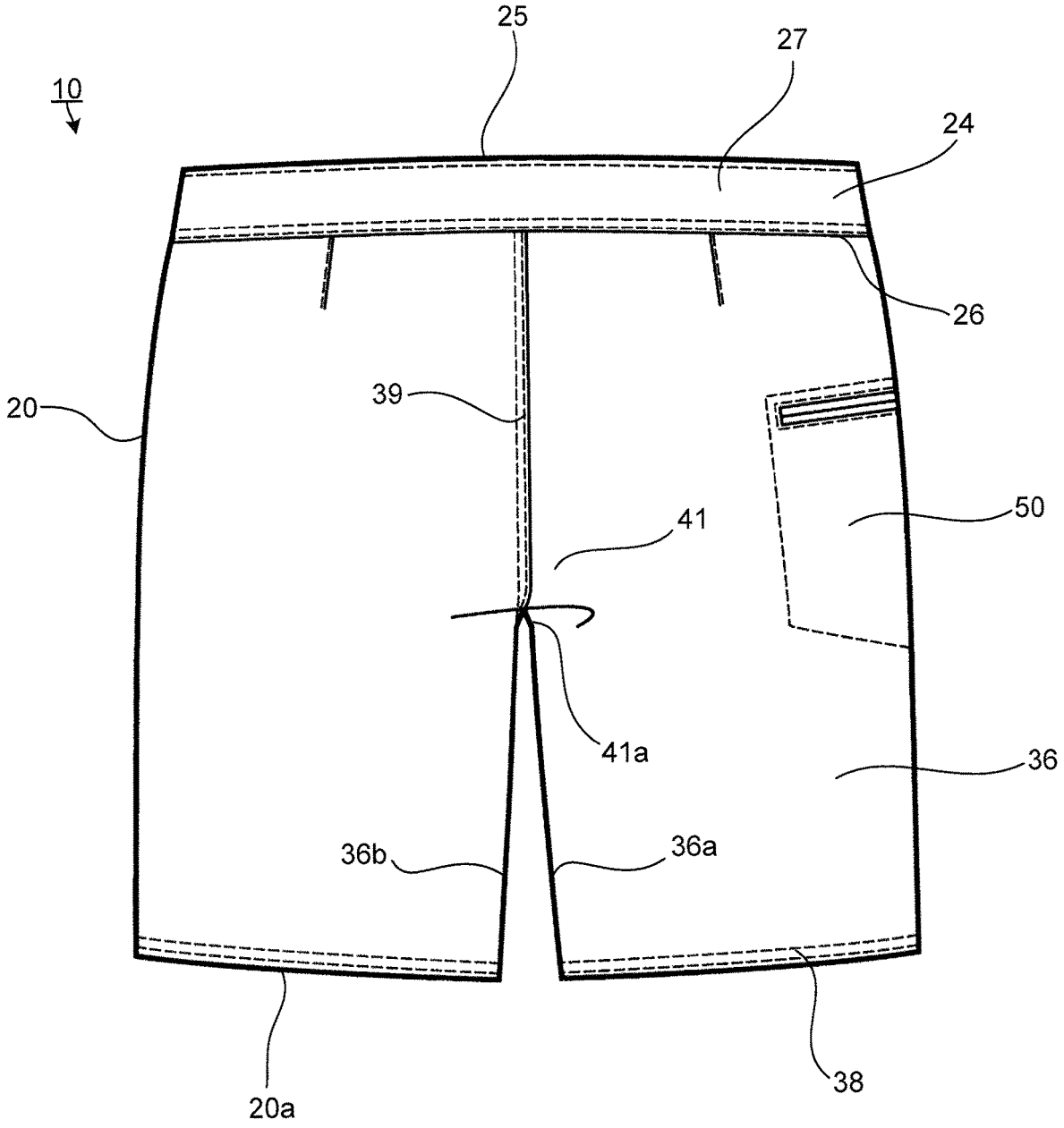
FIG. 2 is a rear view of the garment with insulated liner.

FIGS. 1-2 illustrate the garment with insulated liner 10 may be embodied as preferably as surfing shorts. Although, it is to be understood that the garment with insulated liner 10 may be constructed as a pair of shorts, it is to be understood that various types of stylish short or long pants may be embodied. That is, various patterns, graphics, styles, colors and the like are possible according to this subject disclosure.

FIGS. 3-6 show the insulated liner 30 may be formed of an insulating material, such as Neoprene, capable of covering and conforming to the body of a wearer from the waist to the knees. The insulated liner 30 may be adapted to trap a thin layer of water underneath the insulated liner 30, thereby maintaining the temperature of the thin layer of water similar to the temperature of the body of the wearer from the waist to the knees. Although shown as a short pant garment with an insulated liner, the garment with insulated liner 10 may be embodied in a variety of different styles and shapes for a variety of different uses, such as but not limited to surfers, divers, windsurfers, canoeists, and others engaged in water sports and other activities in or on water, adapted to provide thermal insulation, as well as buoyancy and protection from abrasion, ultraviolet exposure and stings from marine organisms. The insulation property of the garment with insulated liner 10 may be related to the porosity of gas enclosed within the material, which reduces its ability to conduct heat and provide buoyancy in water.

One of the benefits of the insulated liner 30 is to prevent the short pants 20 and the insulated liner 30 from riding up on the leg insuring a warmer, more accurate temperature closer to the temperature of the user wearing the garment with insulated liner 10. Although the insulated liner 30 has been described to be structured with Neoprene, it is to be understood that the insulated liner 30 may be fabricated from a variety of different insulating materials, such as a soft lining, polyester, a synthetic fabric, a wool material, an animal material, a plant fabric, and/or any other suitable material.

FIGS. 1-2 show a pair of stylish outerwear short pants 20 capable of covering, securing in place, and concealing from view the insulated liner 30 which is connected to an inside of the short pants 20 in a manner that will prevent the short pants 20 from shifting when subjected to drastic shifting or turbulent motions, such as a strong wave thrashing a surfer against their surfboard and/or other turbulent motions in the ocean.

In particular, the garment with insulated liner 10 includes various interconnecting fasteners adapted to attach the outerwear short pants 20 to the insulated liner 30 which will be described in more detail later. The short pants 20 and the insulated liner 30 may be attached at various attachment areas to interconnect the insulated liner 30 to the pant shorts 20 in a secure manner so that the short pants 20 do not separate from the insulated liner 30 while engaging in a turbulent watersport activity.

As shown in FIGS. 1-2 (and in FIGS. 3-4 in phantom lines), the short pants 20 are worn to cover at least a substantial portion of the insulated liner 30 so that at least a substantial portion of the insulated liner 30 is concealed from view and securely attached to the short pants 20.

As shown in FIGS. 1 and 3-6, the insulated liner 30 and the short pants 20 include a waistband region 24, a pelvic region 40 below the waistband region 24, a crotch region 41 below the pelvic region 40, and a thigh region 36 adjacent to, and extending staggered below the pelvic region 40 in leg portions of the short pants 20 and insulated liner 30.

The waistband region 24 is bordered by a top end 25 and a lower waist end 26. The waistband region 24 is located above the pelvic region 40 and surrounds the upper end of the garment with insulated liner 10.

The pelvic region 40 is disposed centrally between, and below the waistband region 24 and above the crotch region 41. The pelvic region 40 is also substantially centered above and adjacent to the crotch region 41 and lies substantially behind an upper portion of a fly 32. The pelvic region 40 extends downward from the waistband region 24 to the crotch region 29. As shown, the crotch region 41 lies below the pelvic region 40 and substantially behind and below a lower portion of the fly 32.

The thigh regions 36 approximately begin and are located substantially below the crotch region 41. The thigh regions 36 extend down the legs of the short pants 20 and the insulated liner 30 and extend toward a lower end 38 of the short pants 20 and insulated liner 30 respectively. The thigh regions 36 encircle within a pair of leg openings 21 in the short pants 20 and a pair of leg openings 31 in the insulated liner 30.

According to this subject disclosure, various unique interconnecting fastener attachments are created within the garment with insulated liner 10. The interconnecting fastener attachments may be embodied in a variety of different methods, such as by a stitched seam, a naps fastener, a hook and loop fastener and/or any other interconnecting fastener capable of attaching the short pant 20 to the insulated liner 30.

The interconnecting fastener attachments may be provided in at least part of each of the waist regions 24 of the short pants 20 and the insulated liner 30. The fastener attachment secures the insulated liner 30 to the short pants 20 adjacent to their respective waist regions 24. In addition, the insulated liner 30 may be fastened to various portions of the pelvic region 40 and/or the crotch region 41 of the short pants 20. Likewise, the insulated liner 30 may be fastened to various portions of the thigh regions 36 in the short pants 20, such as adjacent to the lower end 38 of the pant shorts 20.

Figure 3:
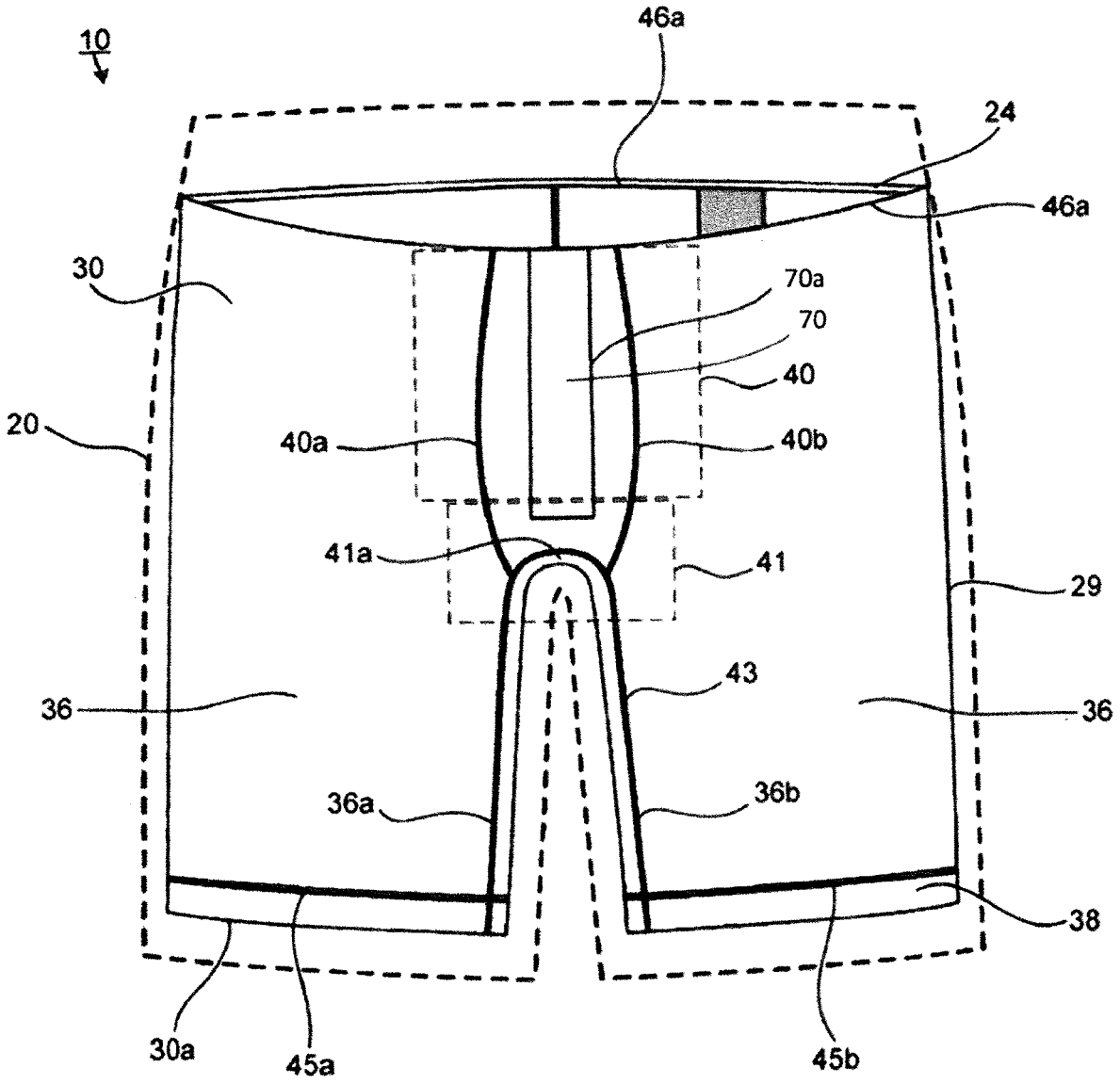
FIG. 3 is a front view of an insulated liner with the garment in phantom lines.
Figure 4:
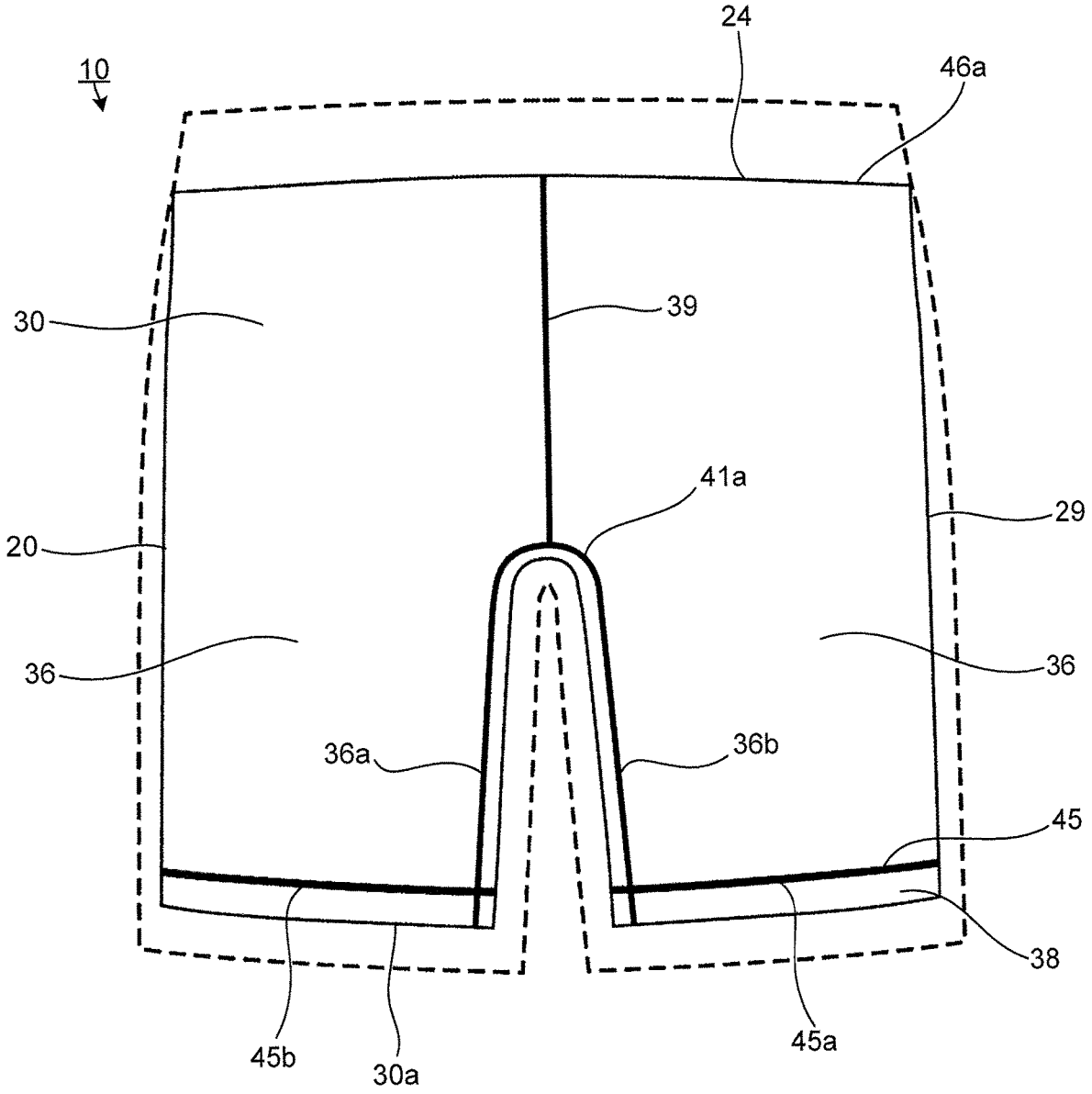
FIG. 4 is a rear view of insulated liner with the garment in phantom lines.
Figure 5:
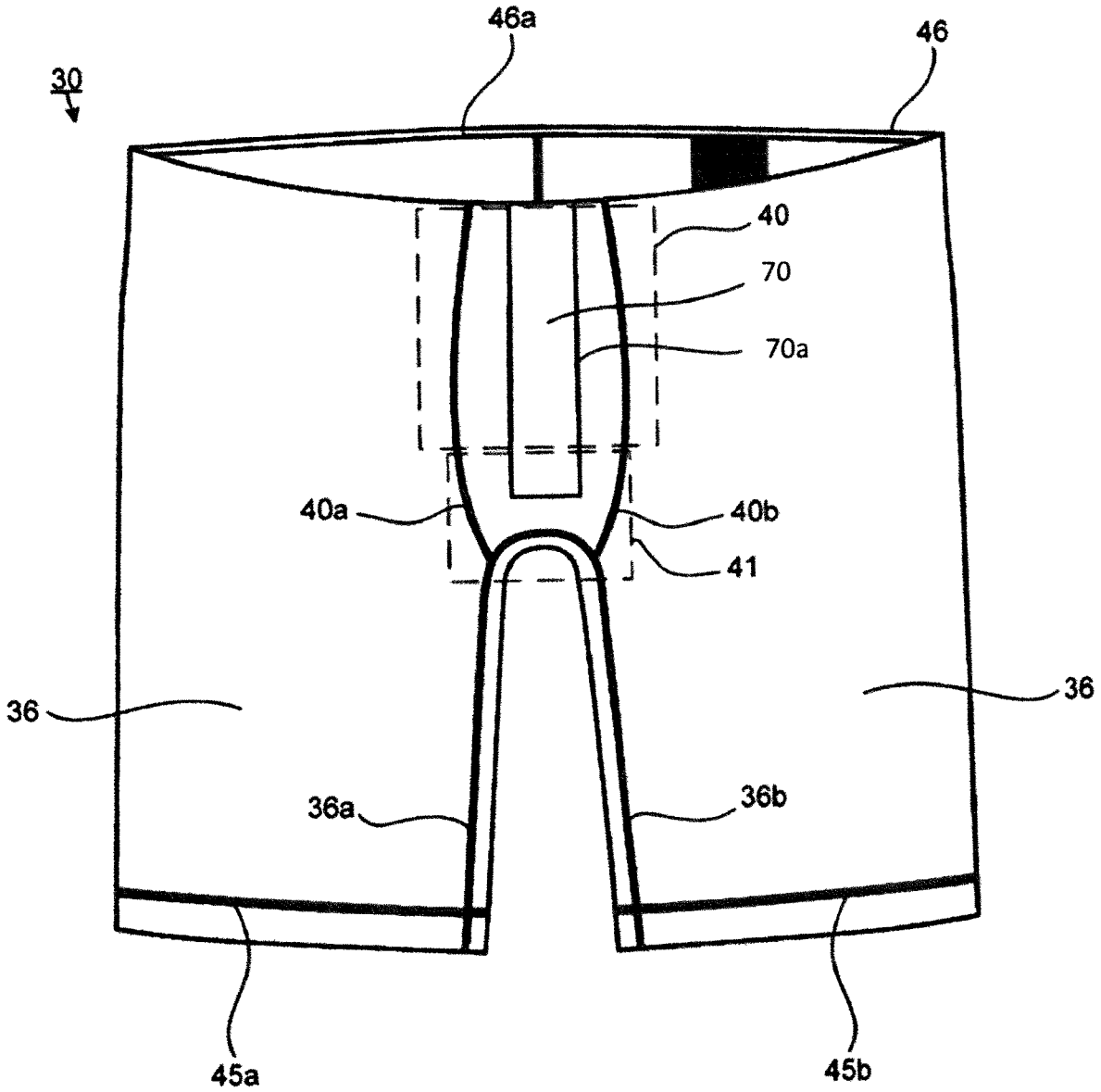
FIG. 5 is a front view of the insulated liner.
Figure 6:
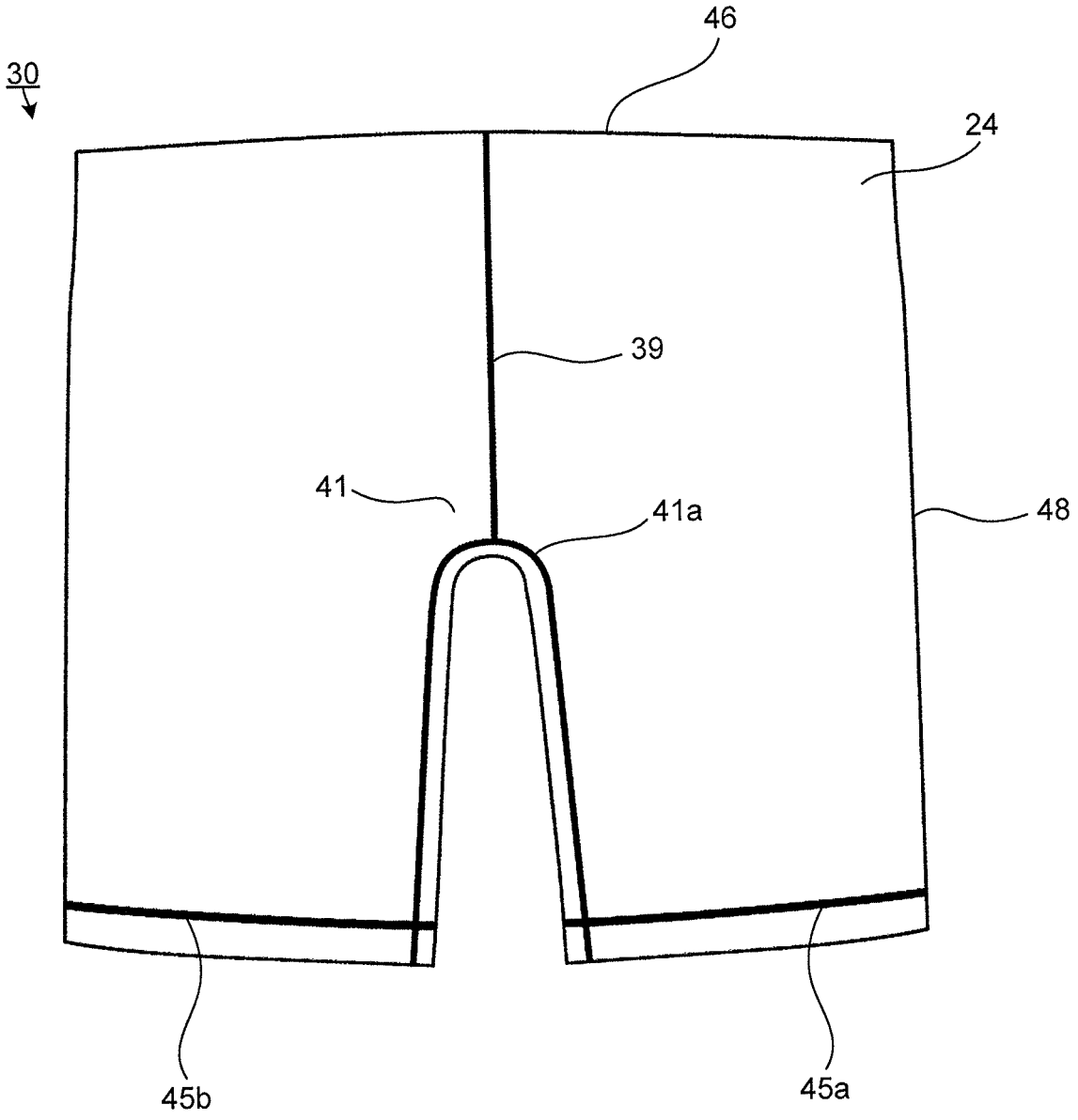
FIG. 6 is a rear view of the insulated liner.

FIGS. 1 and 3-6 illustrate an exemplary attachment mechanism within the garment with insulated liner 10. The attachment mechanism may include a variety of methods for attachment. The attachment mechanism may include a waist seam 46*a* provided at the waistband region 24 as shown in FIGS. 1, 3 and 4 to attach the short pants 20 to the insulated liner 30. The attachment mechanism may include thigh seams 36*a*, 36*b* disposed at the thigh region 36 to attach the short pants 20 to the insulated liner 30.

Likewise, the attachment mechanism may include one or more front seams 40*a*, 40*b*. A shown in FIG. 3, the front seams 40*a*, 40*b* extend from the waist region 24 through the pelvic region 40 and down to the crotch region 41. The front seams 40*a*, 40*b* may connect to the crotch seam 41*a*. Although the front seams 40*a*, 40*b* are shown as a pair of seams extending through the pelvic region 40 and the crotch region 41, the front seams 40*a*, 40*b* could be embodied as various separate seams that are provided through the pelvic region 41 and other separate seams that extend through the crotch region 4.

At the pelvic region 40 of the short pant 20 and the insulated liner 30, the front seams 40*a*, 40*b* secure the short pant 20 and the insulated liner 30 to each other in a secure manner. Likewise, below the pelvic region 40, at the crotch region of the short pant 20 and the insulated liner 30, the front seams 40*a*, 40*b* secure the short pant 20 and the insulated liner 30 to each other in a secure manner. Side seams 29 as shown in FIG. 1, and rear seams 39 may also be provided as shown in FIG. 2.

The attachment mechanism may be various sewn-in stitches at the various regions specified above and/or other locations suitable to secure the short pants 20 to the insulated liner 30 to prevent drastic shifting during turbulent motions. Various methods for and combinations of attaching any combination of the various seams to each other may be used according to this subject disclosure. The seams may utilize any type of sufficient stitching now known or later discovered, such as but not limited to, single needle stitch, bartacks, twin needle coverstitch, flatlock stitch, topstitch, overlock, and the like according to this subject disclosure. As mentioned previously, snaps, hook and loop fasteners and/or any other suitable method of fastening may be used.

A fly region 70 is located in the short pants 20 and the insulated liners 30. The fly region 70 extends from the waistline region 29 downward and midway through the pelvic region 40 and the crotch region 41. A fly seam 70*a* (FIGS. 1, 7, 8 and 9) may be provided to attach the insulated liner 30 to the short pants 20 at the fly region 70.

The combination of these various different seams prevent excess movement of the short pants 20 in relation to the insulated liner 30 and similarly provide stability to the garment with insulated liner 10 when worn by a user. The front seams 40*a*, 40*b* extend through the pelvic region 40 and the crotch region 41, and the fly seam 70*a* work together to conform the general area to accommodate additional mass in comparison to the areas adjacent, while also providing a form-fitting design to regulate and retain heat in the crotch region 43. Furthermore, the area bounded by the front seams 40*a*, 40*b* in the pelvic region 40 and the crotch region 41, and the fly seam 70*a* may be made of a different material or thickness to allow for expansion or additional padding as needed.

A fly region 70 extends through the pelvic region 40 and the crotch region 41 in the short pants 20 and the insulated liner 40. A fly 73 in the fly region 70 may provide easier access when a user requires access to the crotch region 41 and/or the pelvic region 40.

A fly fastener 74 may be disposed in the fly 73 to maintain closure of the fly 73 as well as to prevent undesired movement therethrough. The fly fastener 74 may be made of a hook and loop fastener, zipper, snap, button or any other suitable fastening mechanism according to this subject disclosure. Similarly, the insulated liner 30 may include a fly inner stitch that may provide similar access as necessary. The fly inner stitch may also double as the fly seam 70*a*. Furthermore, the fly fastener 74 may also be disposed between the short pants 20 and the insulated liner 30 to further fasten the short pants 20 and the insulated liner 30 together.

Figure 7:
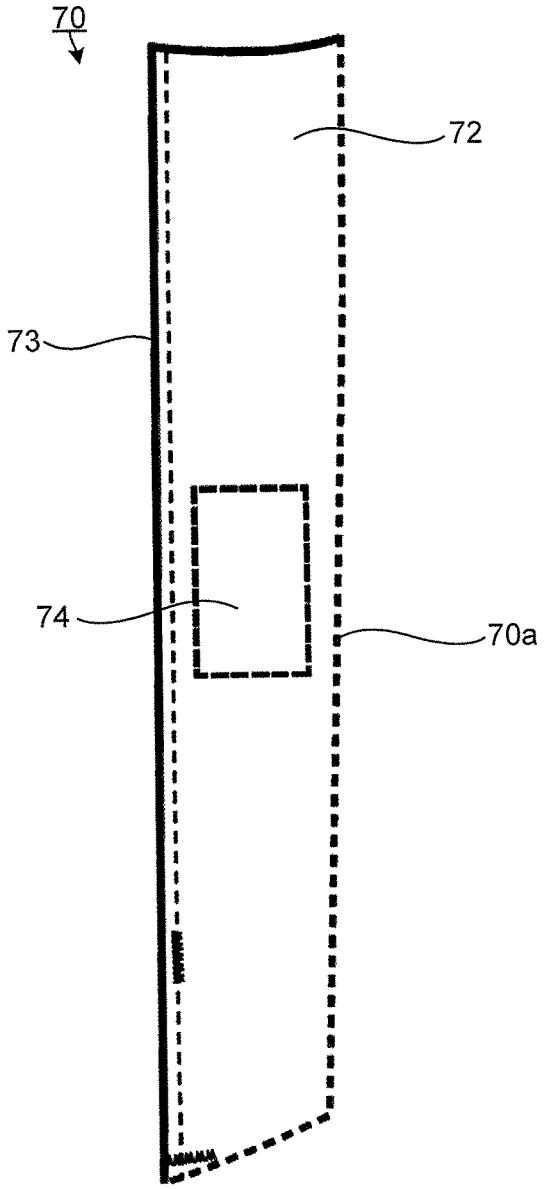
FIG. 7 is a partial front view of a fly with a fly gusset in the fly region.
Figure 8:
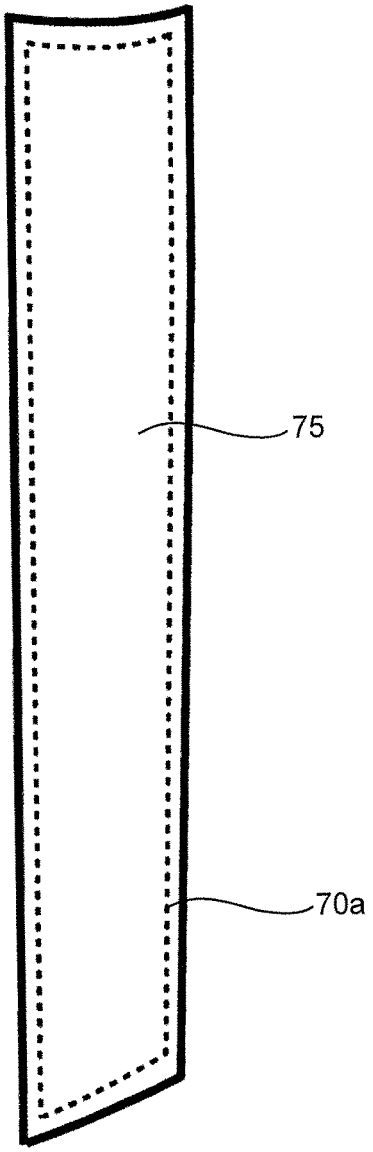
FIG. 8 is a front view of the fly neoprene insert to be inserted into a gusset in the fly.

As shown in FIGS. 7-8, the fly region 70 may include an inner gusset 72 in a stretch knit fabric in the fly 73 of the short pant 20. At the fly region 70, additional fly neoprene 75 may be added to increase the rigidity of the fly region 70 for better and tighter fit adjacent to this region. That is, the additional fly neoprene 75 added to the inner gusset 72 causes the fly 73 of the short pant 20 to be elastically biased back inward against the short pants 20 thereby keeping the fly 73 closed.

It is to be understood that the garment with insulated liner 10 or portions of it may be made of various thicknesses, for different uses and/or different temperatures. The garment with insulated liner 10 may have a thickness in the range from a thin (2 mm or less) to a substantially thick 8 mm liner. It is further to be understood that the garment with insulated liner 10 may be made as a wetsuit or a dry suit. That is, the wetsuit allows water to enter the garment with insulated liner 10, whereas the dry suit is designed to prevent water from entering, thus keeping the portion under the garment with insulated liner 10 dry.

As stated above, the attachment mechanism may include one or more front seams 40*a*, 40*b*. At the crotch region 41, the front seams 40*a*, 40*b* allow the inner insulated liner 30 to be attached to the short pants 20 securely at the crotch region 41. Since the pelvic region 40 and the crotch region 41 are bounded by the front seams 40*a*, 40*b*, and the fly seam 70*a*, the entire crotch region 41 of the insulated liner 30 is then restrained from substantial movement in relation to the short pants 20. More specifically, the front seams 40*a*, 40*b* prevent the short pants 20 from bunching, twisting and other drastic shifting movements, all of which can eventually tear the fastener stitching around a waist of the user. This reduced movement also helps prevent chafing and/or rashes from developing in this sensitive region.

Another benefit of the front seams 40*a*, 40*b* is the ease to which the garment with insulated liner 10 may be put on and taken off. As shown in FIGS. 1 and 2, the front seams 40*a*, 40*b* make it easier for the user to easily slide their legs within the leg openings 20*a*, 30*a* on each respective side of the garment with insulated liner 10.

The waistband region 24 may include a waist seam 46*a* that secures the insulated liner 30 to the short pants 20. The waist seam 46*a* may be stitched entirely around or in portions of the waistband region 24. The waist seam 46*a*, in combination with the attachments front seams 40*a*, 40*b* in the pelvic region 40 and the crotch region 41 further prevent movement of the insulated liner 30 in relation to the short pants 20, which again helps prevent chafing or rashes from developing in the sensitive area.

The waistband region 24 may also include other elements, including a drawstring 22 to adjust a waistband 27. The drawstrings 22 may be capped with hardened tips to allow easy threading through the eyelets 23. The waistband 27 provides an upper border for the garment with insulated liner 10 to snugly fit the user's waist and prevent the garment with insulated liner 10 from falling down and/or off of the user. Alternatively, the waistband region 24 may include an elastic waistband 27 that can stretch to comfortably fit a user.

The drawstring 22 is useful for loosening or narrowing the width of the waistband 27 thereby providing a tighter or more form-fitting fit to the user. The drawstring 22 can be disposed adjacent to, or in the waistband 27 through a plurality of eyelets 23. The drawstring may be comprised of a polyester finish at the waist with a plurality of rubber coated eyelets 23. The eyelets 23 may be disposed on different eyelet tabs or flaps 28 of the waist band 27. The tabs may be further secured by various bartacks or series of stitches used to reinforce this area that will be subjected to enhanced stress or additional wear. When the drawstring 22 is pulled together through the eyelets 23, the flaps 28 are drawn closer and the waistband 26 is thereby narrowed.

The thigh region 36 may also include thigh seams 36*a*, 36*b*. FIG. 3 shows the inner thigh seams 36*a*, 36*b* may attach the insulated liner 30 to the short pants 20. Again, this attachment helps prevent excess movement of the short pants 20, which consequently aids in preventing rashes from forming on the user's thigh region 36. The attachment formed by inner thigh seams 36*a*, 36*b* also provides structure to the short pants 20 when worn by the user. Since the insulated liner 30 is form-fitted to the user, and the short pants 20 is attached to the insulated liner 30 along the inner thigh seams 36*a*, 36*b*, the thigh region 36 of the short pants 20 remains in a shape similar to the user's thigh. Thus, another benefit of the inner thigh seam 43 is that it allows a user to have both the visual look of athletic board shorts and the functionality and benefits of a wetsuit or insulated liner, which include but is not limited to keeping the thigh region 36, crotch region 41 and the pelvic region 40 warm and the prevention of irritating rashes.

As shown in FIGS. 3 and 4, the thigh region 36 of the garment pants with insulated liner 10 may have lower leg seams 45*a*, 45*b*. The lower leg seams 45*a*, 45*b* may provide a tighter fit and prevent excess ballooning of the short pants 20 when a quantity of high pressure water flows or impinges at the lower leg seams 45*a*, 45*b*. As such, the short pants 20 have substantial water-tight properties making it more difficult for the flow of water to enter pass the lower leg seams 45*a*, 45*b*. In the alternative, the lower leg seams 45*a*, 45*b* also assist in a desired amount of drainage of fluid through the insulated liner 30, while also preventing air pockets from forming when the user begins to submerge into the water.

Figure 9:
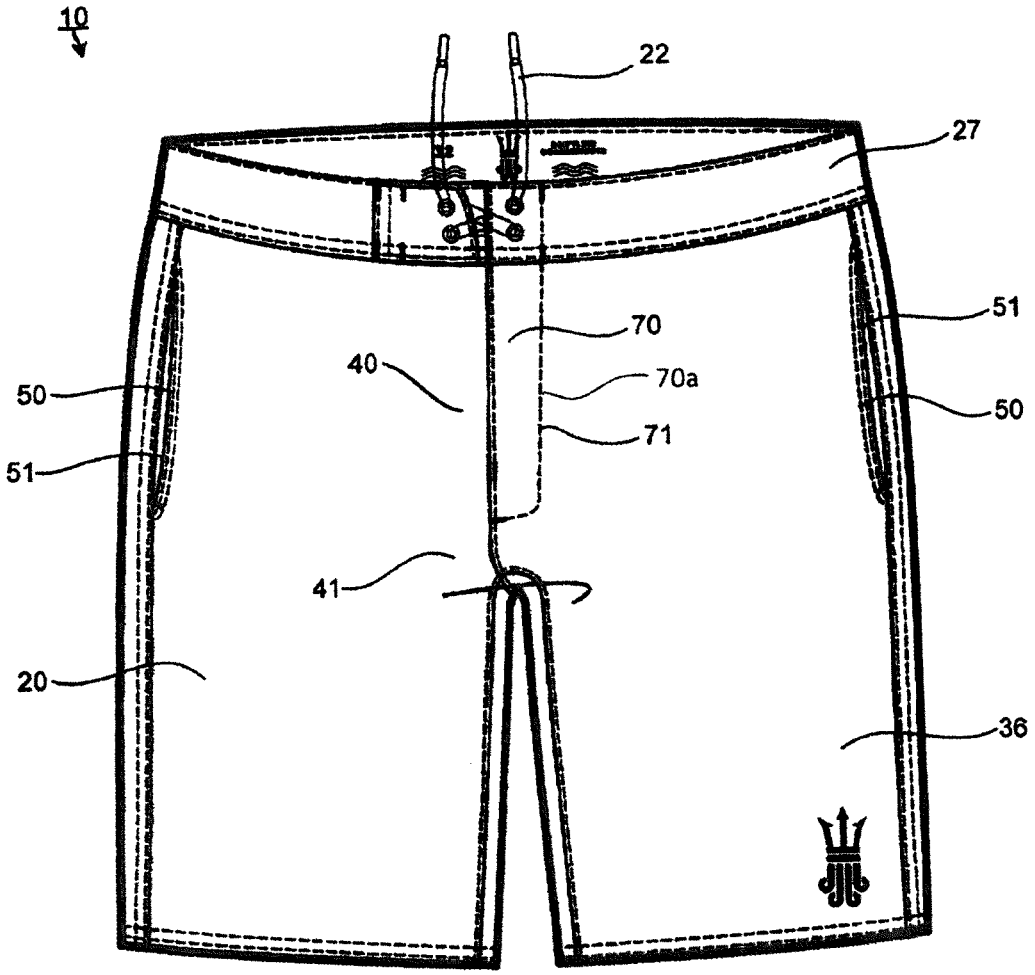
FIG. 9 is a front view of another pocket design for the garment with insulated liner.
Figure 10:
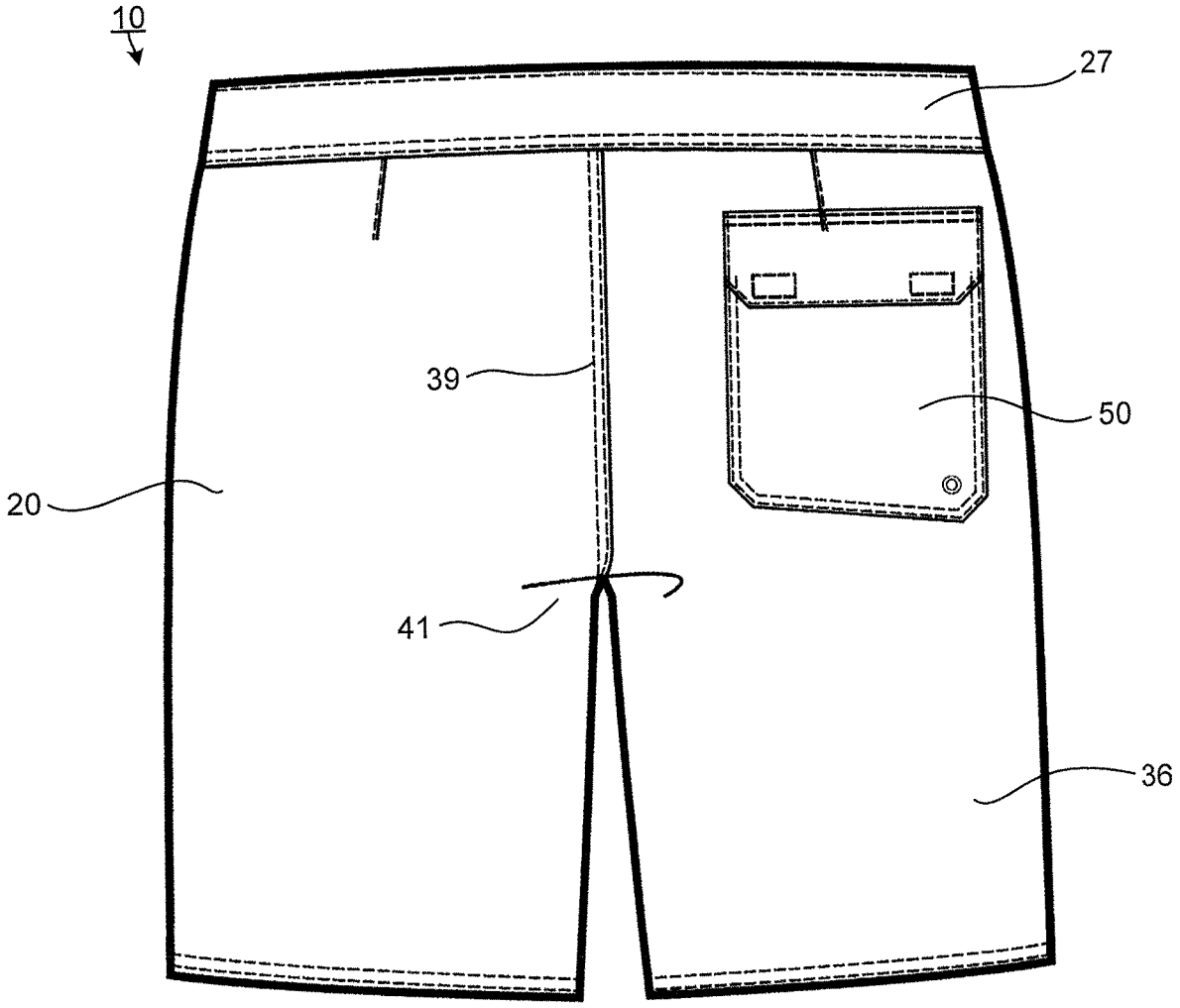
FIG. 10 is a rear view of the pocket design for the garment with insulated liner.
Figure 11:
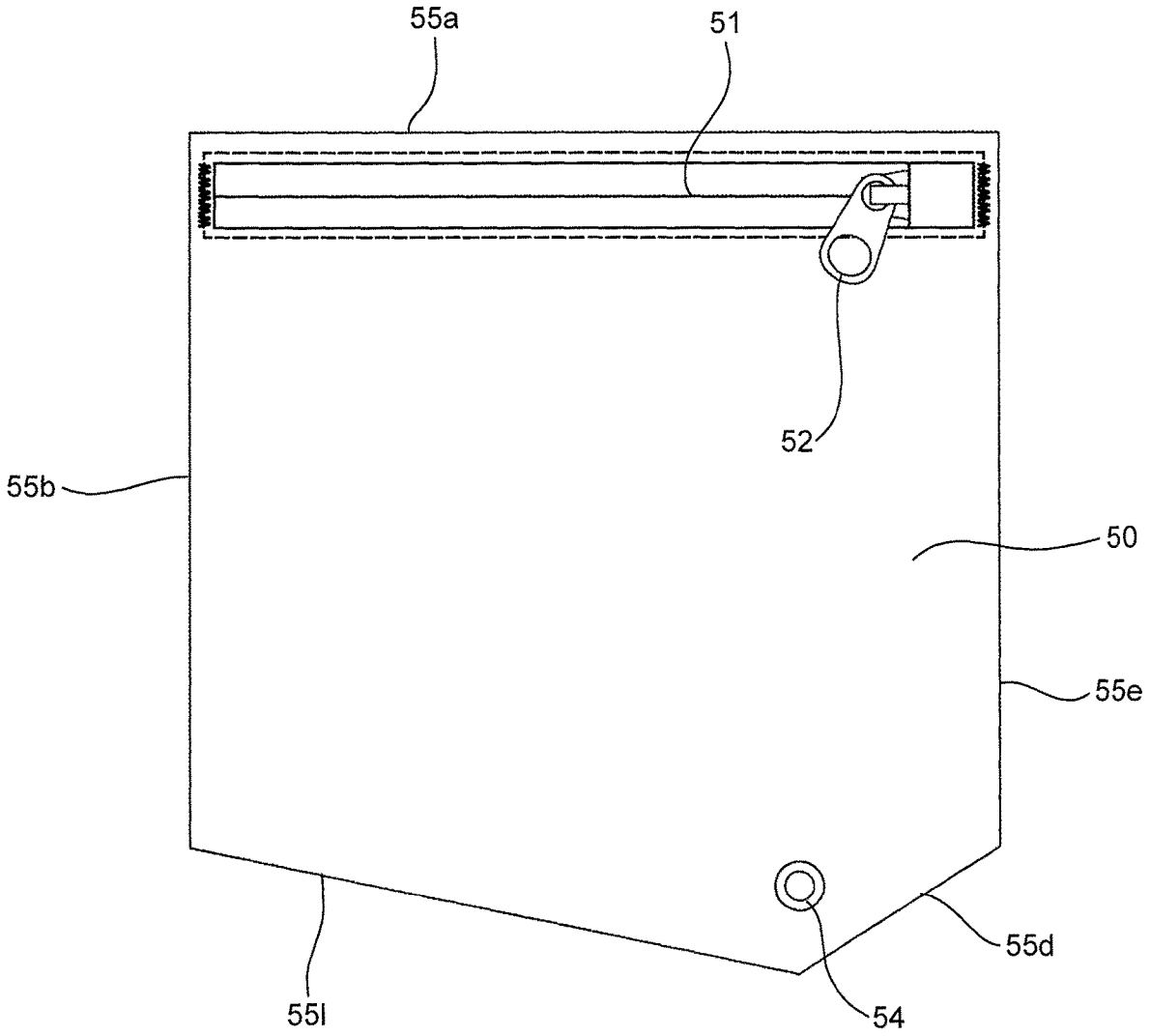
FIG. 11 is an enlarged view of the pocket.

FIGS. 9-11 show that the short pants 20 may also have one or more pockets 50. As shown in FIGS. 10-11, the pocket 50 is bounded on its sided by various seams 55*a*, 55*b*, 55*c*, 55*d*, 55*e*. The pocket 50 may be easily accessible with an opening 51. The opening 51 may be secured closed by a zipper 52. A drainage eyelet 54 may be provided to allow drainage of fluid from within the pocket as necessary.

Alternatively, as shown in FIGS. 1 and 9, the pocket 50 may be internal to the outer surface of the short pants 20 with only the opening 51 accessible. That is, the pocket 50 may have a zipper welt pocket finish with a rubber ended zipper 52.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiments which are described but is intended to cover all modifications and changes within the scope and spirit of the invention.

What is claimed:

1. A garment with insulated liner comprising:

a short pant having a short waistband with a short waist upper end and a short waist lower end, a pair of short leg openings having short leg portions at a short lower end, a short crotch area between and joining the short leg openings, and a short pelvic area located between the short waistband and the short crotch area, a short fly region defining an opening that extends through the short pelvic area and the short crotch area; and a rubberized undergarment having an undergarment waistband with an undergarment waist upper end, a pair of undergarment leg openings having undergarment leg portions at an undergarment lower end, an undergarment crotch area between and joining the undergarment leg openings, and an undergarment pelvic area located between the undergarment waistband and the undergarment crotch area, an undergarment fly region defining an opening that extends through the undergarment pelvic area and the undergarment crotch area, the rubberized undergarment adapted to cover and fit closely to a body of a wearer to preserve an elevated temperature of the body of the wearer under the rubberized undergarment, wherein the undergarment waist upper end is attached to the short waist lower end, and wherein a pair of undergarment front seams of the rubberized undergarment extend from the undergarment waistband through the undergarment pelvic area to the undergarment crotch area, the garment with insulated liner further comprises:

an inner fly flap disposed on one side of the short fly opening and on one side of the undergarment fly opening further comprising a rubberized reinforcement layer, an inner fly seam bordering the inner fly flap and attaching the inner fly flap to the garment with insulated liner, while also attaching the rubberized undergarment to the short pant; and an outer fly flap disposed on another side of the short fly opening an on another side of the undergarment fly opening further comprising another rubberized reinforcement layer, an outer sea bordering the outer fly flap and attaching the outer fly flap to the garment with insulated liner, while also attaching the rubberized undergarment to the short pant, the inner and outer fly flaps securely prevent the rubberized undergarment from drastically shifting in turbulent water.

2. The garment with insulated liner recited in claim 1, wherein the rubberized reinforcement layer and the another reinforcement layer provides rigidity and biases the short fly region closed against the undergarment region.

3. The garment with insulated liner recited in claim 1, wherein a short waist seam is provided around the short waistband of the short pant and the rubberized undergarment to secure the short waist lower end of the short pant to the undergarment waist upper end of the of the rubberized undergarment.

4. The garment with insulated liner recited in claim 1, wherein thigh seams at the lower end of the pair of short leg openings and the pair of undergarment leg openings secure the short pant to the rubberized undergarment.

5. The garment with insulated liner recited in claim 1, wherein the short pant has a pocket.

6. A garment with insulated liner comprising:

a short pant with a short waistband having a short waist upper end and a short waist lower end, a pair of short leg openings having short leg portions at a short lower end, a short crotch area between and joining the short leg openings, and a short pelvic area located between the short waistband and the short crotch area, a short fly region defining an opening that extends through the short pelvic area and the short crotch area; and a neoprene undergarment with a neoprene waistband having a neoprene waist upper end, a pair of neoprene leg openings having neoprene leg portions at a neoprene lower end, a neoprene crotch area between and joining the neoprene leg openings, and a neoprene pelvic area located between the neoprene waistband and the neoprene crotch area, an undergarment fly region defining an opening that extends through the neoprene pelvic area and the undergarment crotch area, the neoprene undergarment adapted to cover and fit closely to a body of a wearer to preserve an elevated temperature of the body of the wearer under the neoprene undergarment, the garment with insulated liner further comprises:

an inner fly flap disposed on one side of the short fly opening and on one side of the undergarment fly opening further comprising a neoprene reinforcement layer, an inner fly seam bordering the inner fly flap and attaching the inner fly flap to the garment with insulated liner, while also attaching the neoprene undergarment to the short pant; and an outer fly flap disposed on another side of the short fly opening an on another side of the undergarment fly opening further comprising another neoprene reinforcement layer, an outer fly seam bordering the outer fly flap and attaching the outer fly flap to the garment with insulated liner, while also attaching the neoprene undergarment to the short pant, where, in a closed position, the inner and outer fly flaps overlap and increases the elasticity and rigidity of the garment with insulated liner at the short fly region and the undergarment region, and wherein the neoprene waist upper end is also attached to the short waist lower end, and wherein the inner and outer fly flaps overlap in the closed position to prevent the neoprene undergarment and the short pant from drastically shifting in turbulent water.

7. The garment with insulated liner recited in claim 6, wherein the pair of front neoprene seams extend around the short fly region of the short pant from the neoprene waist upper end to a neoprene crotch seam.

8. The garment with insulated liner recited in claim 6, wherein the short pant has a pocket.

9. A garment with insulated liner comprising:

a short pant with a short waistband having a short waist upper end and a short waist lower end, a pair of short leg openings having short leg portions at a short lower end, a short crotch area between and joining the short leg openings, and a short pelvic area located between the short waistband and the short crotch area, a short fly region defining an opening that extends through the short pelvic area and the short crotch area; and an insulated rubberized undergarment with an undergarment waistband having an undergarment waist upper end, a pair of undergarment leg openings having undergarment leg portions at an undergarment lower end, an undergarment crotch area between and joining the undergarment leg openings, and an undergarment pelvic area located between the undergarment waistband and the undergarment crotch area, an undergarment fly region defining an opening that extends through the short pelvic area and the short crotch area, the insulated rubberized undergarment adapted to cover and fit closely to a body of a wearer to preserve an elevated temperature of the body of the wearer under the insulated rubberized undergarment, wherein a pair of undergarment front seams of the insulated rubberized undergarment extend from the undergarment waistband through the undergarment pelvic area to the undergarment crotch area, the garment with insulated liner further comprises:

an inner fly flap disposed on one side of the short fly opening and on one side of the undergarment fly opening further comprising a rubberized reinforcement layer, an inner fly seam bordering the inner fly flap and attaching the inner fly flap to the garment with insulated liner, while also attaching the rubberized undergarment to the short pant; and an outer fly flap disposed on another side of the short fly opening an on another side of the undergarment fly opening further comprising another rubberized reinforcement layer, an outer fly seam bordering the outer fly flap and attaching the outer fly flap to the garment with insulated liner, while also attaching the rubberized undergarment to the short pant, the inner and outer fly flaps overlap in a closed position to prevent the insulated rubberized undergarment and the short pant from drastically shifting in turbulent water.

10. The garment with insulated liner recited in claim 9, wherein a short waist seam is attached to, and provided around the short waistband and the undergarment waistband to secure the short waist lower end to the undergarment waist upper end.

11. The garment with insulated liner recited in claim 9, wherein short thigh seams are disposed at a lower end of leg openings of the short pant to secure the short pant to the insulated rubberized undergarment at a thigh region of the short pant and the insulated rubberized undergarment.

* * * * *